US005125670A

United States Patent [19]

Hamlett, II et al.

[11] Patent Number: 5,125,670

[45] Date of Patent: Jun. 30, 1992

[54] VERTICAL BACKBOARD-TETHER BALL AMUSEMENT DEVICE

[76] Inventors: James R. Hamlett, II; James R. Hamlett, both of 4033 Meadowbrook Rd., Rocky Mount, N.C. 27801

[21] Appl. No.: 774,853

[22] Filed: Oct. 11, 1991

[51] Int. Cl.[5] ..... A63B 67/10

[52] U.S. Cl. ..... 273/413; 273/319

[58] Field of Search ..... 273/413, 319, 329, 330

[56] References Cited

U.S. PATENT DOCUMENTS

| | | | |
|---|---|---|---|
| 786,997 | 4/1905 | Rosenthal | 273/413 |
| 2,437,454 | 3/1948 | Bergerioux | 273/413 X |
| 2,570,860 | 10/1951 | Redding | 273/329 |
| 2,769,636 | 11/1956 | Finestone | 273/413 X |
| 2,792,225 | 5/1957 | Coursey | 273/330 X |
| 2,851,272 | 9/1958 | Shatzer | 273/413 |
| 3,093,376 | 6/1963 | Terry | 273/330 |
| 4,127,270 | 11/1978 | Pretorius | 273/330 |

*Primary Examiner*—William H. Grieb

*Attorney, Agent, or Firm*—Rhodes, Coats & Bennett

[57] ABSTRACT

The present invention entails an amusement device played by two players. The amusement device comprises a vertical backboard having a tethered ball secured to the top edge thereof. Each player is provided with a paddle for engaging the tethered ball. The object of the game revolves around a player hitting the tethered ball with the paddle causing it to be impacted against the facing side of the vertical backboard which results in the tether ball swinging upwardly over the top edge of the vertical backboard and impacting against the opposite side of the backboard. After impact the second player stationed on the opposite side of the backboard hits the tether ball with his paddle causing the tether ball to be slammed or pounded against the facing side of the backboard after which the tether line connecting the ball to the backboard guides the tether ball over the top edge of the vertical backboard to where the tether ball impacts against the opposite side of the backboard.

8 Claims, 3 Drawing Sheets

VERTICAL BACKBOARD-TETHER BALL AMUSEMENT DEVICE

FIELD OF INVENTION

The present invention relates to tethered ball amusement devices and more particularly to tether ball amusement devices played by two players with paddles for engaging and knocking the tether ball back and forth between the two players.

BACKGROUND OF THE INVENTION

For many years, children and young adults have enjoyed the fun and excitement of repeatedly pounding a tether ball against a paddle where the tether ball is actually attached to the paddle. This amusement device is commonly referred to a paddle ball game. While conventional paddle ball games are fun and exciting and to at least some extent tends to develop good hand and eye coordination, they have one major shortcoming. Conventional paddle ball games do not lend themselves to individual player versus player competition. That is, with conventional paddle ball games a player has to essentially play against himself.

Beyond that, with a conventional paddle ball game the tether ball tends to repeatedly follow a predictable flight path from the paddle. Expressed in another way, because of the nature of the paddle ball device and the way the game is played, the tether ball tends to react and respond essentially the same way time after time.

There is a need for a tether ball game that can be played in a competitive fashion by two players where the tether ball is pounded back and forth between two players in such a fashion that test one's hand and eye coordination and his or her skill level in hitting the tether ball under various playing conditions.

SUMMARY AND OBJECTS OF THE INVENTION

The present invention entails a tether ball game apparatus that is specifically designed to be played by two or even more players. Forming a part of the tether ball game apparatus of the present invention is a vertical backboard having a tether ball secured to the top edge of the vertical backboard. In the course of playing the game, a player stands on opposite sides of the vertical backboard and with a paddle in hand hits the tether ball against the facing surface of the backboard causing the tether ball to rebound against that facing surface and to swing over the top edge of the vertical backboard where the tether ball impacts against the opposite side of the vertical backboard. A second player standing on the opposite side of the vertical backboard, with a paddle in hand, then hits the tether ball after it has rebounded from his side of the vertical backboard. In hitting the tether ball the same is pounded or hit against the facing side of the vertical backboard and because of the manner of securing the tether line extending from the tether ball, the tether ball is confined about the vertical backboard and tends to fly over the top edge of the vertical backboard to where it impacts on the opposite side of the backboard. After impact, the facing the side of the backboard where the tether ball rebounds from, then hits the tether ball in like fashion causing it to be pounded against the facing side of the vertical backboard resulting in the form of play just described. Preferably, points are only awarded to a serving player and the first player to reach a selected number of points is declared the winner.

It is therefore an object of the present invention to provide a tether ball game apparatus or device that can be played by two players.

Another object of the present invention is to provide a new and exciting tether ball game played by two competing individuals wherein the game is focused about a backboard that during the course of the game is impacted by the tether ball.

It is also an object of the present invention to provide a tether ball game that can be played by a wide range of children and adults.

Another object of the present invention resides in the provision of a tether ball game that is easy and fun to play.

Still a further object of the present invention resides in the provision of a tether ball game of the character referred to above that tends to improve hand and eye coordination.

Another object of the present invention resides in the provision of a tether ball game apparatus that can be quickly and easily assembled and disassembled.

It is also an object of the present invention to provide a tether ball game apparatus of a design that can be easily stored in a closet or underneath a bed.

A further object of the present invention resides in the provision of a competitive tether ball game apparatus of the character referred to above that is durable in construction and easy to maintain.

Other objects and advantages of the present invention will become apparent and obvious from a study of the following description and the accompanying drawings which are merely illustrative of such invention.

DETAILED DESCRIPTION OF THE INVENTION

Figure 1:
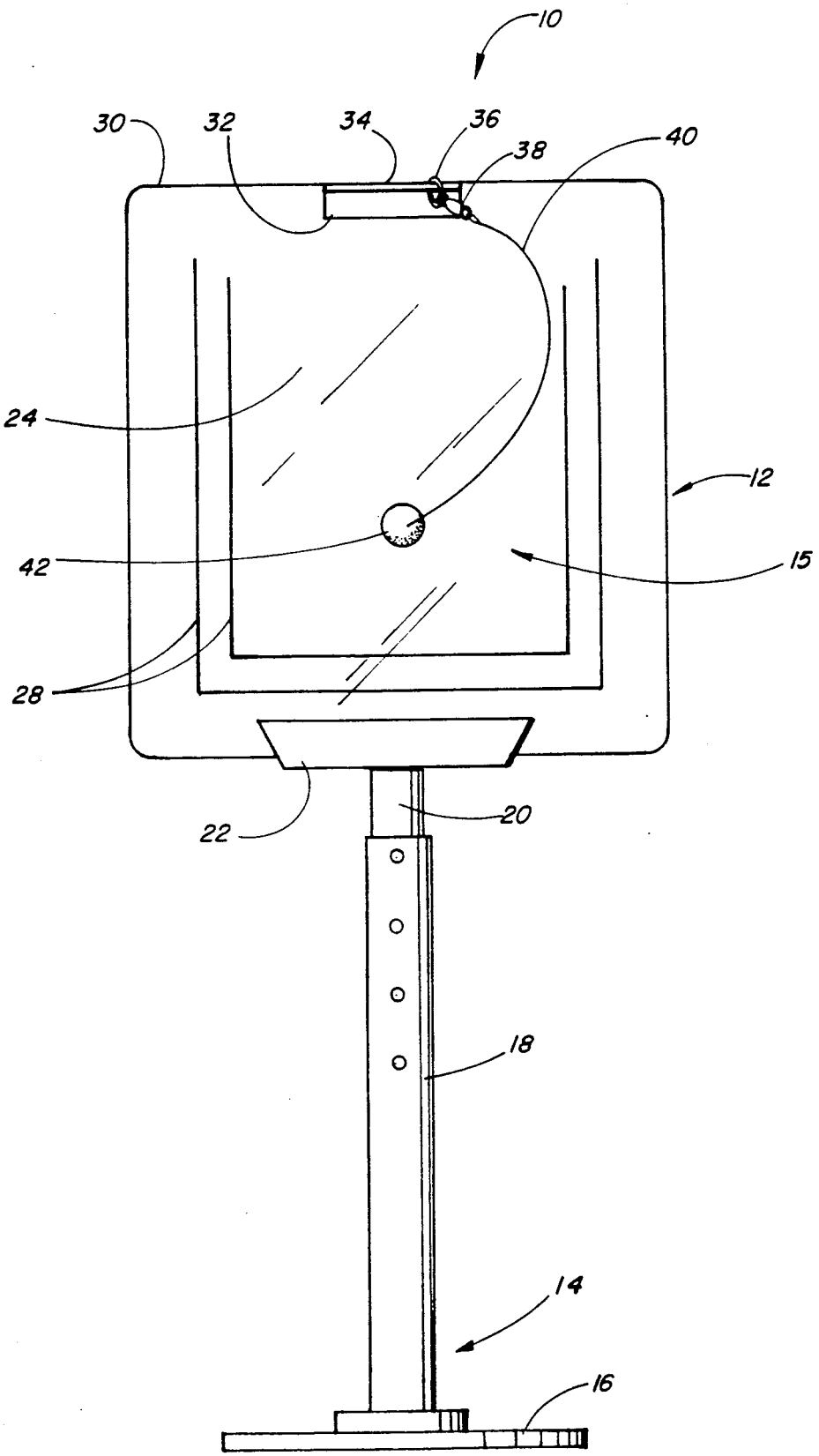
FIG. 1 is a front elevational view of the tether ball amusement device of the present invention.
Figure 2:
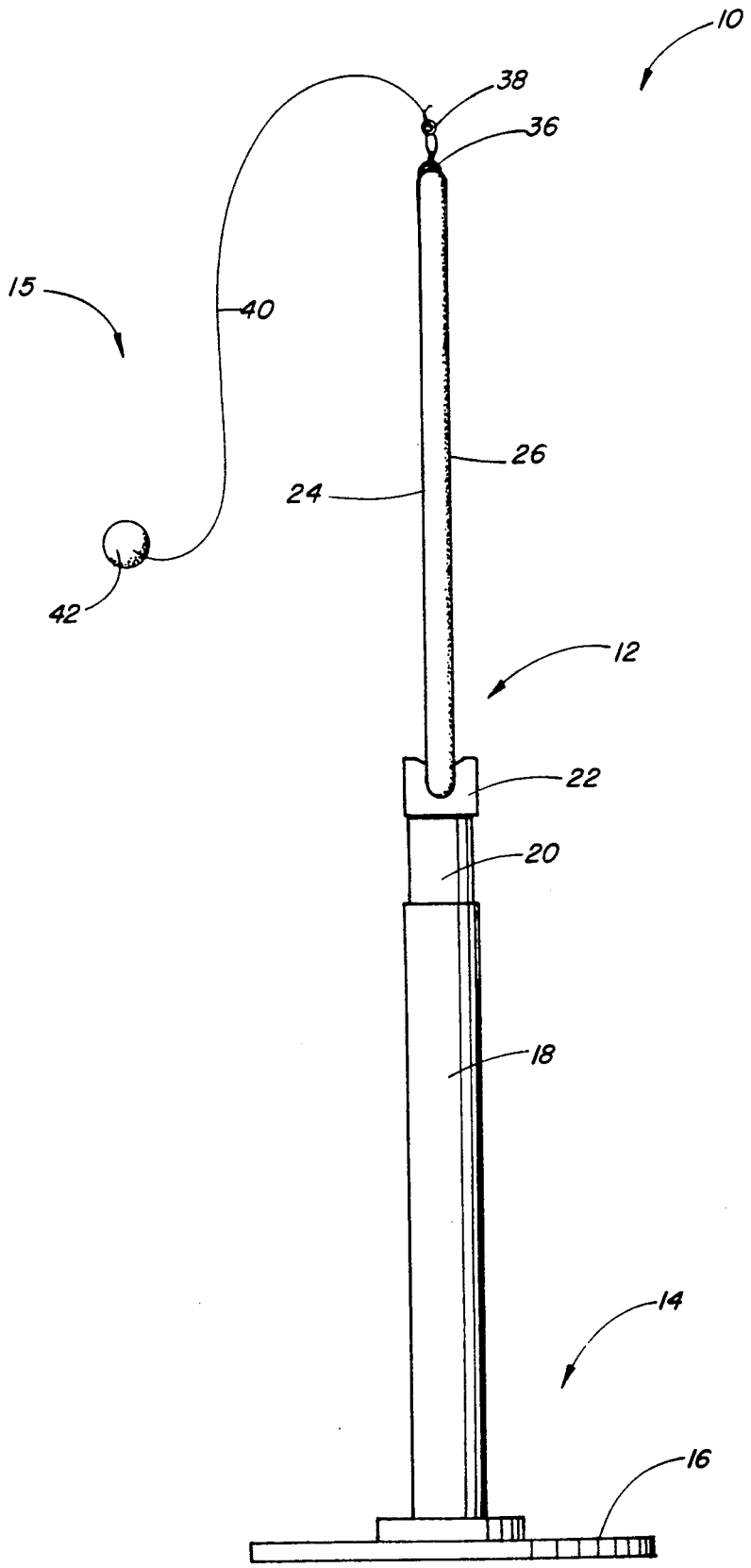
FIG. 2 is a side elevational view of the tether ball amusement device of the present invention.

With further reference to the drawings, the tether ball game apparatus of the present invention is shown therein and indicated generally by the numeral 10. Tether ball game apparatus 10 basically comprises a vertical backboard 12, a support structure 14 for supporting the vertical backboard 12, and a tethered ball 15 secured to the backboard 12.

Viewing the support structure 14 in more detail, it is seen that the same includes a lower base 16 having a lower tube 18 extending upwardly therefrom. An upper tube 20 is telescopically contained within the lower tube 18 and is adjustable therein such that the height of the vertical backboard 12 can be easily and readily adjusted. Secured to the top of upper tube 20 is an elongated v-strip 22 that is designed to receive and hold the vertical backboard 12.

As seen in the drawings, vertical backboard 12 comprises a generally square or rectangular board constructed of wood, plastic or other suitable materials. A pounding or playing surface 24 and 26 is provided on each side of the vertical backboard 12. There is also provided framing indicia 28 that tends to mark or inscribe a playing area within the surfaces 24 and 26. Extending across the top of the vertical backboard 12 is an upper edge 30. A cutout 32 is formed in the upper edge 30. To mount the tether ball 15 about the upper portion of the vertical backboard 12, there is provided a shaft 34 that spans cutout 32 and is generally disposed along the upper edge 30 of the vertical backboard 12. Confined on the shaft 34 is a ring 36. Ring 36 can freely rotate about shaft 34 and can move from side to side along the shaft. Secured to the ring is a conventional swivel assembly 38. The tether ball, indicated generally by the numeral 15, is in turn connected to the swivel 38. In particular, the tether ball 15 includes a tether line 40 connected to the swivel 38 while a ball 42 is connected directly to the tether line 40.

For striking ball 42 and playing the tether ball game of the present invention, the game apparatus of the present invention is provided with a plurality of paddles 44.

In playing the tether ball game apparatus 10 of the present invention, one or more players will be placed on opposite sides of the vertical backboard 12. The principal object of the present invention is to keep the tether ball moving back and forth over the top edge 30 of the backboard 12. This is accomplished by a player impacting the ball 42 and causing the ball to be pounded against a playing surface 24 or 26 of the vertical backboard 12. Once ball 42 has impacted the pounding surface 24 or 26, then the ball will rebound and under the guidance of the tether line 40 and its associated mounting means, the tether ball will be confined and guided such that it will fly or move over the top edge 30 of the backboard 12. As the ball 42 clears the upper edge 30 of the vertical backboard 12 the tether ball is guided downwardly to where it will impact the playing surface of the opposite side. As the tether ball impacts that particular surface of the vertical backboard, the player facing that side of the backboard will then ready himself to strike the rebounding tether ball 42. Upon striking the rebounding tether ball 42, the ball is again caused to be pounded or impacted against that side of the vertical backboard facing the player and after such impact the ball will swing up over the upper edge 30 of the vertical backboard towards the opposing player. Again, in like fashion, the ball will move downwardly and impact the other side of the backboard 12. Again, the object of the game is to keep the ball moving back and forth between opposite sides or surfaces 24 and 26 of the vertical backboard 12 and to force one's opponent to miss the tether ball or fail to properly return the ball back over the upper edge 30 of the vertical backboard 12.

The game may be played and scored in various ways but is preferred that the game be played such that points are only scored by the player "serving". Thus, once a selected point total is reached by a player, then that player is declared the winner.

In serving, a player holds the tether ball away from the backboard and simply releases the tether ball 42 and strikes the same in the same motion causing the ball to be pounded against that player's side of the backboard and rebounded back over to the other side of the backboard. It is important that the player's serve or return pass over the upper edge of the backboard 12 and actually impact against the opposite side of the backboard. If in making a serve or a return, a player is unable to clear the upper edge 30 of the backboard 12 and to impact the opposite side of the backboard 12, then a point is scored against him or he or she loses serve.

Thus, a player maintains serves so long as he is successful in hitting the ball against the facing side of the backboard and then impacting the other side of the backboard without the opposing players then able to appropriately return. A successful return requires that the tether ball 42 be hit such that it impacts the opposite side of the backboard 12 and has at least some rebound sufficient for the opposing player to strike the ball after impact. It must be kept in mind that the rules require that the tether ball not be directly hit over the upper edge 30 of the vertical backboard 12 but in the course of hitting the tether ball 42 to the opposite side of the backboard 12 that the tether ball must first be impacted or pounded against that player's side of the backboard. It is the impact of the ball against a player's particular side that causes the ball to move up and over the upper edge of the backboard and impact against the opposite side. To cause the tether ball 42 to impact against a player's side of the backboard 12 and then to pass over the top edge of the backboard the tether ball 42 is struck with a downward swinging motion. By striking the ball 42 with a downward swinging motion, the ball is hit downwardly at the backboard causing the tether line 40 to stretch. Thus, once the tether ball 42 has been extended by the stretching tether line 40, it follows that the elastic nature of the tether line 40 will cause the tether ball 42 to pass over the top edge 30 of the backboard 12. Essentially, shaft 34 serves as a pivot axis for the swinging tether line 40.

As mentioned before hand, it is important that in the course of playing the game that the tether ball 42 pass over the top edge 30 of the backboard 12. It may be possible for a player to cause the tether ball 42 to reach the opposite side of the backboard 12 without passing directly over the top edge 30. In particular, by striking the tether ball 42 a certain way, it may be possible for the ball and tether line to swing around one side of the game board and impact the opposite side thereof. That is a foul and an unsuccessful serve or return. The tether ball 42 must actually pass over the top edge of the backboard 12.

It follows that when a server fails to win a point that the serve changes to the other player without the addition of any points to either player. That is, a player can only score points while he or she is serving. In either case, whether viewed from the server's standpoint or the opposing player's standpoint, a "winner" is achieved when the tether ball has been successfully impacted against the opposite side of the playing board 12 and the player facing that side is unable to return the tether ball to the opposite side for impact.

Figure 3A:
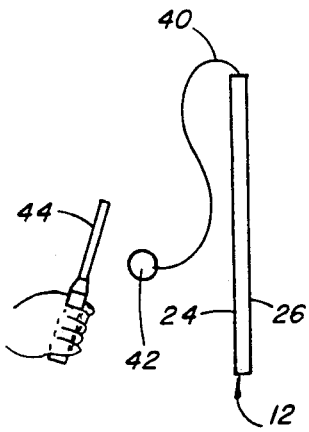
FIGS. 3*a*–3*i* are a sequence of views illustrating how the tether ball amusement device of the present invention is played.
Figure 3B:
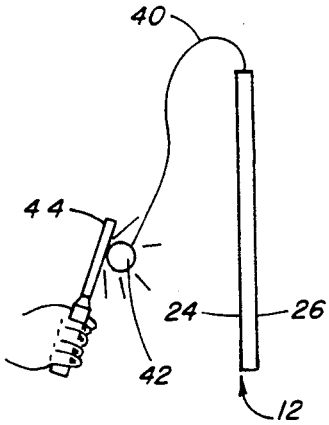
Figure 3C:
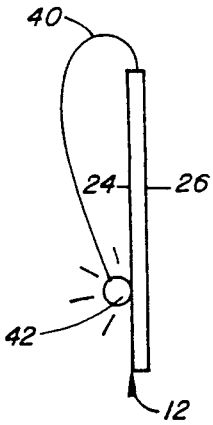
Figure 3D:
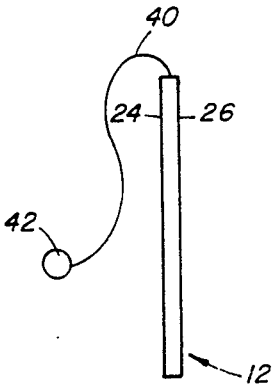
Figure 3E:
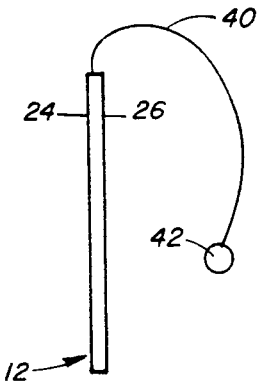
Figure 3F:
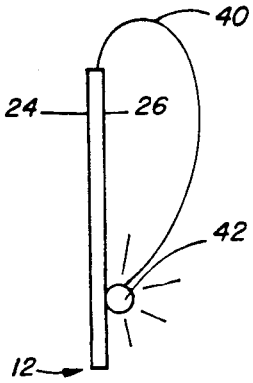
Figure 3G:
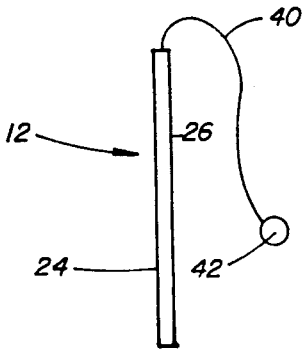
Figure 3H:
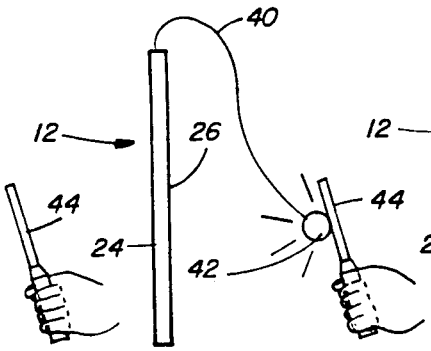
Figure 3I:
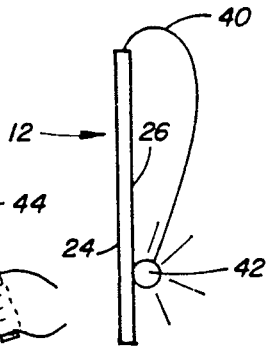

FIGS. 3*a*–3*i* basically illustrates how the tether ball amusement device of the present invention is used by two players during the course of a game. FIG. 3*a* shows the tether ball 42 just after it has been dropped by the serving player and before the paddle 44 engages the same. Once tether ball 42 has been dropped then the paddle 44 in a downward motion is caused to strike the tether ball 42. (FIG. 3*b*). The striking of the tether ball 42 causes the same to impact against the playing surface 24 of the backboard 12. (FIG. 3*c*). Once impacted against playing surface 24 the tether ball 42 then moves clockwise as viewed in FIG. 3*c*. Note in FIG. 3*d* the tether ball 42 has begun its upward flight. FIG. 3*e* shows the tether ball 42 passing towards the opposite side of the backboard 12. There tether ball 42 engages the opposite side 26 of the backboard and rebounds therefrom. (FIG. 3*g*). In FIG. 3*g*, it is seen that the second player is standing ready to hit the tether ball 42 with paddle 44. In FIG. 3*h* the second player is shown actually hitting tether ball 42 with the paddle 44. After paddle 44 has impacted tether ball 42 the same engages playing surface 26 of backboard 12 just as in the case described above with respect to FIG. 3*c*. Thereafter, the tether ball 42 will rebound and if the player has made a proper return then the tether ball 42 will move up and over the top edge of the backboard 12 and will rebound against the first side or playing surface 24 of the backboard 12. There, the first player will again attempt to strike the tether ball and return the same.

The game board apparatus 10 of the present invention and particularly the mounting of the tether ball 15 thereto, creates very interesting and exciting action and reactions during the course of a game. The ring and swivel arrangement enables the tether ball to swing back and forth from side to side of the vertical board with "twist english". Thus, the tether ball can be caused to rebound in certain unpredictable directions. As players become more advanced and skilled in playing the game of the present invention, the players will be able to inpart spin to the ball and this spinning action will cause the tether ball to rebound in very unique and unpredictable ways.

From the foregoing specification and discussion, it seen that the present tether ball game apparatus of the present invention presents an exciting and interesting tether ball game and one apparatus that can be played by either two players or even perhaps by four players playing doubles. The tether ball game of the present invention is exciting and tends to develop and improve one's hand and eye coordination.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An amusement device comprising:

a) a vertical backboard having opposed vertical ball playing surfaces;

b) a support structure connected to the vertical backboard for supporting the same above a support surface;

c) the vertical backboard including a top edge, an upper portion, and a lower portion;

d) a tethered ball including a ball connected to a tether line connected to the upper portion of the vertical backboard;

e) mounting means for mounting the tethered ball for back and forth movement over the top edge of the vertical backboard such that when the ball is pounded against one ball playing surface the mounting means confines the tethered ball to an area around the vertical backboard and permits the tethered ball to move from one playing surface over the top edge of the vertical backboard and to rebound off the opposite playing surface of the backboard; and f) a pair of hand held player paddles for striking the tethered ball against a playing surface and causing the ball to rebound over the top edge of the backboard and to impact against the playing surface on the opposite side of the backboard.

2. The amusement device of claim 1 wherein said mounting means includes a shaft mounted on the upper portion of the vertical backboard; a ring confined around the shaft and movable from side to side on the shaft; a swivel connected to the ring; and wherein the tether line is connected to the swivel thereby enabling the tethered ball to move from playing surface to playing surface over the top edge of the vertical backboard without incurring substantial twist within the tether line.

3. The amusement device of claim 1 wherein the support structure includes a telescoping vertical tube assembly that permits the height of the backboard to be vertically adjusted.

4. The amusement device of claim 2 wherein the vertical backboard includes a cutout formed about the upper portion thereof and wherein the shaft forming a part of the mounting means spans at least a portion of the cutout.

5. The amusement device of claim 3 wherein the vertical backboard is of a generally square shape.

6. The amusement device of claim 5 wherein each vertical ball playing surface includes indicia that forms a ball playing area on the playing surface.

7. A method of playing a tethered ball game having a vertical backboard separating first and second players and a tethered ball connected to an upper portion of the vertical backboard comprising the steps of:

a) the first player hitting the tethered ball with a paddle and slamming the tethered ball against a facing surface of the vertical backboard causing the tethered ball to rebound against that surface;

b) confining the tethered ball about the vertical backboard such that the tethered ball tends to swing over the top edge of the vertical backboard after being hit and rebounding against the side of the vertical backboard facing the first player;

c) after swinging over the top edge of the vertical backboard the tethered ball impacting against the opposite side of the vertical backboard and rebounding therefrom; and d) hitting the tethered ball after the last rebound by a second player causing the tethered ball to be pounded against the second player's side of the vertical backboard resulting in the tethered ball swinging over the top edge of the vertical backboard to impact against the opposite side of the vertical backboard.

8. The method of claim 7 including the step of swinging the tether ball about a shaft secured to the top portion of the vertical backboard.

* * * * *